US006185478B1

(12) United States Patent
Koakutsu et al.

(10) Patent No.: US 6,185,478 B1
(45) Date of Patent: Feb. 6, 2001

(54) PRINTING APPARATUS, CONTROL METHOD FOR A PRINTING APPARATUS, AND RECORDING MEDIUM FOR RECORDING A CONTROL PROGRAM FOR A PRINTING APPARATUS

(75) Inventors: Naohiko Koakutsu; Mitsuaki Teradaira, both of Shiojiri (JP)

(73) Assignee: Seiko Epson Corporation, Tokyo (JP)

( * ) Notice: Under 35 U.S.C. 154(b), the term of this patent shall be extended for 0 days.

(21) Appl. No.: 09/084,531

(22) Filed: May 26, 1998

(30) Foreign Application Priority Data

May 29, 1997 (JP) ..... 9-140675

(51) Int. Cl.[7] ..... G06F 7/00
(52) U.S. Cl. ..... 700/213; 700/228; 700/230
(58) Field of Search ..... 700/213, 228, 700/230; 347/262, 264, 215, 217, 218, 153, 164, 104; 400/582, 583

(56) References Cited

U.S. PATENT DOCUMENTS 4,925,325 5/1990 Niikawa .
5,035,413 7/1991 Yamada et al. .
5,648,812 7/1997 Igarashi .

FOREIGN PATENT DOCUMENTS 0 180 059 5/1986 (EP) .
0 312 407 4/1989 (EP) .
0 486 031 5/1992 (EP) .
0 519 518 12/1992 (EP) .
61-66671 4/1986 (JP) .
1-103472 4/1989 (JP) .
2-024172 1/1990 (JP) .
6-031999 2/1994 (JP) .

*Primary Examiner*—David H. Bollinger
(74) *Attorney, Agent, or Firm*—Michael T. Gabrik

(57) ABSTRACT

A printer and control method therefor for printing to a specific location on an inserted form whether the form is loaded automatically or manually in the printer. When a specific command is received from a host, the printer selects the insertion operation used for the printing form. If automatic loading is selected, the leading edge of the form is set to a specific position in the printer by a form transportation mechanism, and printing then begins. If manually positioned form insertion is selected, printing begins directly with the printing form as inserted and positioned by the user.

6 Claims, 11 Drawing Sheets

PRINTING APPARATUS, CONTROL METHOD FOR A PRINTING APPARATUS, AND RECORDING MEDIUM FOR RECORDING A CONTROL PROGRAM FOR A PRINTING APPARATUS

BACKGROUND OF THE INVENTION

1. Field of the Invention

The present invention relates to a printing apparatus for printing to a cut-sheet form, to a printing apparatus capable of selecting an operation to be performed when a cut-sheet form is inserted, to a method for controlling such a printing apparatus, and to a recording medium for storing the control method and related control program.

2. Description of the Related Art

FIG. 11 shows an example of a printer that prints on cut paper (slip paper). This printer 9 is provided with paper path 11 which extends in the horizontal direction and in which printing paper 1 is fed from the right side of the figure for printing. Along this paper path 11, starting from the right side, the printer 9 includes BOF (Bottom of Form) sensor 21 for sensing the presence of slip paper 1 and the end of the paper during printing, paper-feeding roller 31 and paper-pressing roller 32 for feeding slip paper 1 along paper path 11, platen 36 and printing head 37 for printing slip paper 1, TOF (Top of Form) sensor 22 for sensing the presence of slip paper 1 and the leading edge of the paper, and form stopper 15 for positioning the paper by striking the leading edge of paper 1 when slip paper 1 is inserted into paper path 11. Next to these components, paper guide 14 for guiding printed paper 1 to the paper discharge port is provided. In this printer 9, printing area 35, equipped with platen 36 and print head 37, is formed inside the area (insertion area 12) in which slip paper 1 is inserted into a predetermined position by placing its leading edge against form stopper 15, thus shortening the distance that paper 1 must travel and enabling fast printing.

Printer 9 is further provided with platen drive mechanism 40 which moves platen 36 up and down in the direction perpendicular to paper path 11 and which pushes platen 36 toward print head 37 after slip paper 1 has been inserted into insertion area 12 so that paper 1 can be printed. Platen drive mechanism 40 is provided with platen frame 42 which pushes platen 36 upward with spring 41, platen opening/closing rod 43 which controls the up and down movements of platen frame 42 by contacting inclined area 42*a* of platen frame 42, and opening/closing solenoid 44 which moves the position of platen opening/closing rod 43. When platen opening/closing rod 43 is moved in the left/right directions of FIG. 11 by opening/closing solenoid 44, platen frame 42 moves either downward or upward, making it possible for platen 36 to enter and exit from paper path 11. Furthermore, paper-feeding roller 31, working with platen frame 42, moves with platen 36, and slip paper 1 inserted into insertion area 12 is clamped between paper-pressing roller 32 and paper-feeding roller 31, and thus the movements of paper 1 can be controlled by paper-feeding mechanism 34. As explained above, the paper-feeding mechanism of printer 9 becomes active or inactive in linkage with opening/closing of the platen.

Furthermore, since platen opening/closing rod 43 also contacts inclined area 16*a* of stopper frame 16 which rotatably supports form stopper 15, and this inclined area 16*a* faces the opposite direction from inclined area 42*a* of platen frame 42. Consequently, the movement of opening/closing rod 43 makes platen 36 protrude into paper path 11 and at the same time makes form stopper 15 withdraw from paper path 11. Since the setting of printing paper 1 is completed in this way, slip paper 1 is fed to the proper position by paper-feeding roller 31, and furthermore, print head 37 is moved by a drive mechanism (not shown in FIG. 11) in the scanning direction perpendicular to the paper-feeding direction, thereby printing paper 1 in the desired locations.

Paper-feeding mechanism 34 is also equipped with paper-feeding motor 33 for driving rollers 31 and 32 and control unit 50 which can control printing by print head 37. Signals from TOF sensor 22 and BOF sensor 21 are input into control unit 50, and the process of installing slip paper 1 in printer 9 is controlled by having these sensors 21 and 22 check for the presence of slip paper 1.

As described above, a slip form indexing operation is automatically performed when a form is inserted to a conventional printer as a means of ensuring that the form is correctly positioned and is printed at a specific position.

However, there are cases in which it is desirable to position a specific part of a form to be printed to the position traversed by the print head, and then print with the form in the selected position. This is referred to below as "targeted printing." One exemplary application for targeted printing is check printing, or more specifically, printing the amount to a specific position on the check. In the conventional printer described above, however, a form is automatically indexed to a predetermined position in the paper path when the form is inserted, and targeted printing to a specific desired position on the form is therefore not possible.

Objects of the Invention

Therefore, it is an object of the present invention to overcome the aforementioned problems.

It is another object of the present invention to provide a printing apparatus that can selectively apply the process performed when a form or paper to be printed is inserted according to a printing objective.

It is yet another object of the present invention to provide a method for controlling such a printing apparatus and a recording medium for storing a control program for causing the method to be performed.

SUMMARY OF THE INVENTION

The present invention is therefore directed to a printing apparatus whereby the process performed upon printing form insertion is selectively controlled according to a printing objective.

According to one aspect of the invention, a printing apparatus is provided which comprises: a printing unit including a print head that prints to a cut-sheet form according to print data or a print command received from a host device; a detector for detecting the presence of a cut-sheet form; a transport mechanism for transporting a cut-sheet form; a control unit for positioning the leading edge of a cut-sheet form to a specific position based on a detection result from the detector by driving the transport mechanism; and a selector for enabling or disabling operation of the control unit according to a specific command received from a host device. By storing the value set by the selector, it is only necessary to set the operating state of the control unit once, and it is not necessary to change the setting until a change in the operating state is required.

When an indexing operation for automatically setting a form inserted to the printing apparatus to a specific position is not required, the indexing operation can be disabled, thereby enabling the printing apparatus to be used according to the current printing objective. When the indexing operation is disabled, a form to be printed can be inserted with the desired printing position aligned to the printing position of the print head, thereby enabling printing to a selected position.

The printing apparatus of the invention further comprises means for temporarily enabling operation regulated by the control unit irrespective of the selector setting if the detection result from the detector indicates there is no paper after print data or a print command has been received from the host device when operation regulated by the control unit has been disabled by the selector. This makes it possible to prevent paper jams and carriage misalignment when a printing form is inserted after print data or a print command has been received and the indexing operation has been disabled because the indexing operation is temporarily enabled and executed.

A printing apparatus according to the present invention further preferably comprises a first insertion opening for inserting a cut-sheet form parallel to the direction in which a cut-sheet form is transported by the transport mechanism, and a second insertion opening for inserting a cut-sheet form in a direction substantially perpendicular to the transportation direction.

By thus providing a second insertion opening, a form to be used for targeted printing can be inserted from the second insertion opening, thereby making insertion easier. In this case, the printing apparatus further preferably comprises a housing for housing at least the print unit where the housing has a mark proximal to the printing means on the second insertion opening side. This mark can then be used as an index for inserting a printing form for targeted printing, thereby helping to ensure the printing form is correctly positioned and printed.

The present invention is further directed to a method for controlling a printing apparatus comprising an interface for communicating with a host device, a detector for detecting the presence of a cut-sheet form, a transport mechanism for transporting a cut-sheet form, and a printing unit for printing to a cut-sheet form. The control method according to the present invention comprises the steps of: receiving print data or a print command from a host device; detecting the presence of a cut-sheet form; positioning the leading edge of an inserted cut-sheet form to a specific position by transporting and detecting the cut-sheet form; printing to the cut-sheet form according to received print data or a received print command; and skipping the printing form positioning step according to a specific command from a host device. By further comprising the step of storing the setting controlling whether the printing form positioning step is skipped, it is only necessary to set the execution state of the position step once unless it is necessary to change the setting. Moreover, when the positioning step is set to skip and the form detecting step detects that a form is not present, the positioning step is executed.

The control method of a printing apparatus according to the present invention can be provided as a control program implementing the above-described control steps, and can be embodied in an article of manufacture such as a computer memory, a floppy disk, a compact disk or the like for storing the control program. The control program can also be provided by means of a computer network or communications network, including the Internet or other on-line communications system. In this case, the control program can be downloaded from such a network for storage to a local recording medium, from which it can then be used by a user's personal computer or printing apparatus.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

Figure 2:
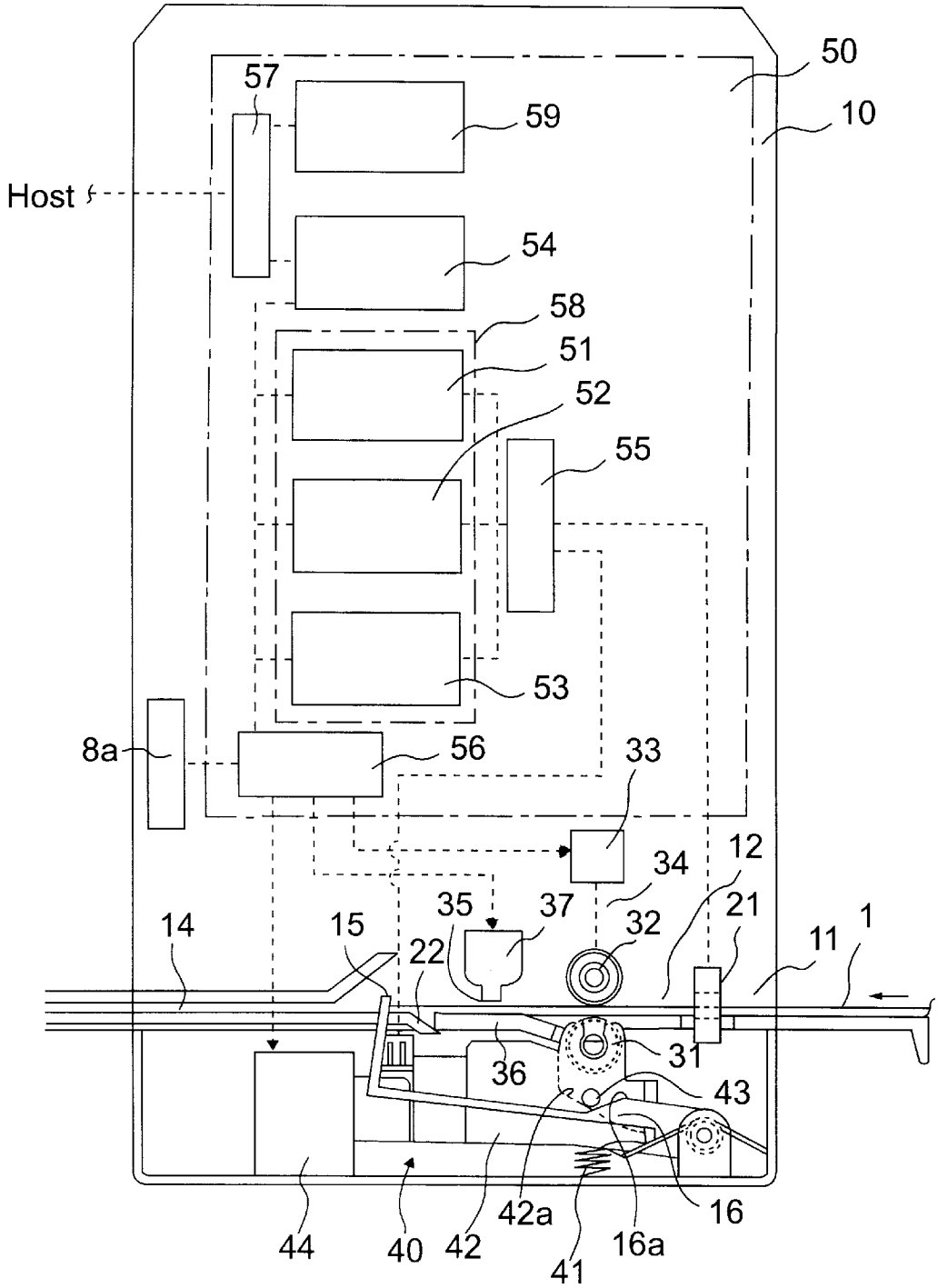
FIG. 2 is a cross-sectional view of the printer shown in FIG. 1 with portions shown in block diagram form.
Figure 11:
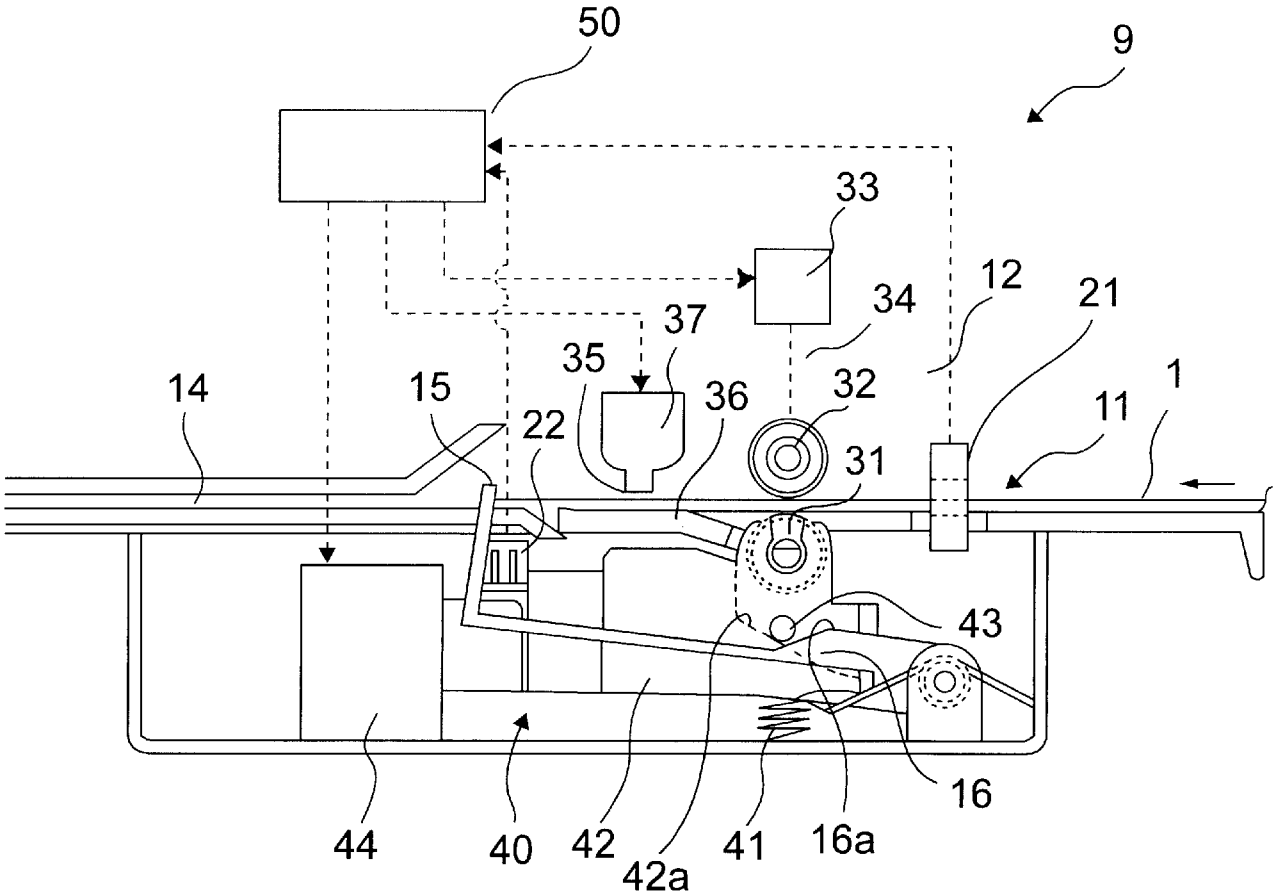
FIG. 11 is a cross-sectional view of a printer, with portions shown in block diagram form, according to the prior art.

The preferred embodiments of the present invention are described below with reference to the accompanying figures, of which FIG. I is an external perspective view of a printer 10 according to a preferred embodiment of the invention. An arrangement of the substantial components of the printer 10 are shown in FIG. 2 with particular attention to the components disposed along the paper path 11. As with the printer described above and shown in FIG. 11, the printer 10 of the present embodiment comprises, in order along the paper path 11 from the right side thereof as shown in FIG. 2, a BOF sensor 21, a paper feed roller 31 and paper presser roller 32 of a paper transport or feed mechanism 34 which includes a drive motor 33, a printing area 35 equipped with a platen 36 and print head 37, a TOF sensor 22, and a form stop 15. A paper guide 14 for conducting the printed form 1 to a paper exit is further disposed on a downstream side, shown at the left in the figure.

The printer 10 further comprises a platen drive mechanism 40 for moving platen 36 up and down in a direction perpendicular to paper path 11. The paper feed mechanism 34 can be set to an operating or non-operating state in conjunction with closing and opening of platen 36.

The platen drive mechanism 40 comprises a platen frame 42, which functions to raise platen 36 by means of a spring 41; a platen opening/closing rod 43 for controlling the up and down movement of the platen frame 42 by means of contact with an incline 42*a* of the platen frame 42; and a drive solenoid 44 for moving the position of the platen opening/closing rod 43. When the platen opening/closing rod 43 is moved right and left as seen in FIG. 2 by the drive solenoid 44, the platen frame 42 moves up and down, thereby moving the platen 36 into or out of the paper path 11. Movement of platen frame 42 also causes the paper feed roller 31 that is part of the paper feed mechanism 34 to move concomitantly with the platen 36, thereby holding a slip form 1 inserted in an insertion area 12 between the paper presser roller 32 and paper feed roller 31. Movement of the slip form 1 can thus be controlled by the paper feed mechanism 34. The paper feed mechanism 34 in a printer 10 according to the present invention is thus set to a non-operating or operating state in conjunction with platen opening and closing.

The platen opening/closing rod 43 also contacts an incline 16*a* of paper stop frame 16, which supports the form stop 15 in a pivotable manner. Note that the incline 16*a* of the paper stop frame 16 slopes in the opposite direction from the incline 42*a* of the platen frame. As a result, when the platen 36 moves into the paper path 11 as a result of the platen opening/closing rod 43 moving, the form stop 15 separates from paper path 11. A print form can thus be transported by paper feed roller 31, the print head 37 moved in a direction perpendicular to the paper transport direction by a drive means not shown in FIG. 2, and content can be printed to a desired position on the slip form 1.

Figure 1:
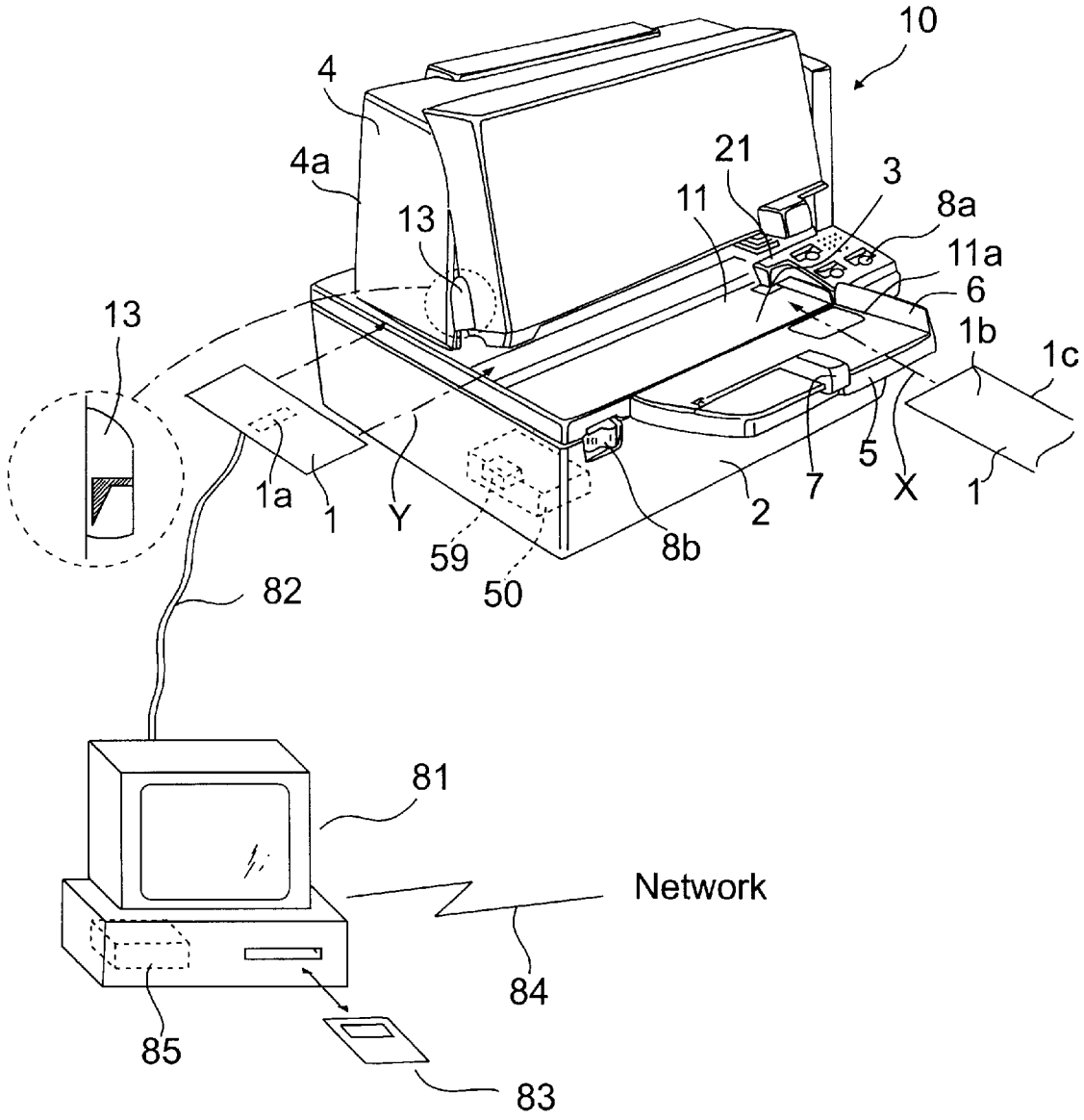
FIG. 1 is a perspective view of a printer, shown connected to a host computer, according to a preferred embodiment of the present invention.

As shown in FIG. 1, the printer 10 according to the present embodiment comprises a base 2 substantially in the form of a rectangular parallelepiped. The top of the base functions as a table 3 used for paper path 11. At approximately the middle of the base 2 is attached a top cover 4 in which are housed the print head 37 and appurtenant components such as an ink ribbon and carriage mechanism, not shown in FIG. 1.

A document table 5 is disposed on the slip form 1 insertion side (the front or right side as shown in FIG. 1) of the table 3 as an extension of the table 3, thereby forming a flat paper path 11 continuous to below the top cover 4. A fixed paper guide 6 extending to a point proximal to the BOF sensor 21 is provided on one side of the document table 5; this fixed paper guide 6 thus forms one edge (the right edge as seen in FIG. 1) 11*a* of the paper path 11. A short, movable paper guide 7 for adjusting the width of the paper path 11 to the width of the printing form 1 is provided on the side of the paper path 11 opposite the fixed paper guide 6.

It is therefore possible to insert a printing form to the insertion area 12 of the paper path 11 in a printer 10 according to the present embodiment without skewing the form alignment by inserting the slip form 1 with one edge 1*c* thereof following the fixed paper guide 6.

With a table 3 thus configured, a slip form 1 can be inserted in the X direction shown in FIG. 1 along the paper path 11 using the paper guides 6 and 7, or perpendicularly to the paper path 11 for targeted printing to a specific position 1*a* on slip form 1 as indicated by arrow Y in FIG. 1. To facilitate printing form alignment in this case, a mark 13 indicating the position of print head 37 travel, and therefore indicative of the location of printing area 35 in paper path 11, is provided on the side 4*a* of top cover 4 from which the printing form is inserted, that is, the left side as seen in FIG. 1. It is therefore possible to align a form 1 for targeted printing with this mark 13 to facilitate correct positioning.

An operating panel 8*a* used for local control of a printer 10 according to the present embodiment is provided on the right side of table 3 as seen in FIG. 1. A power switch 8*b* is provided on the base 2. A control unit 50 for controlling various components of the printer 10 according to a control program and commands indicated using the operating panel 8*a* is also provided in the printer 10. This control unit 50 comprises flash memory 59 or other storage for storing such information as the control program and settings.

The printer 10 is connected to a host 81 by means of an interface cable 82 or communications interface such as an infrared transceiver, thereby enabling print data, control data, and other information to be exchanged between the printer 10 and host 81.

The printer 10 can be controlled from an application program running on the host 81, or a control program can be received from the host 81 via the interface and written to flash memory 59. The host 81 also has the ability to read and/or write such portable recording media as floppy disks 83 and ROM cards, which can be used to supply a control program to the printer 10.

The host 81 may further have telecommunications functionality enabling communication via the Internet or other computer network 84. When thus comprised, a control program can be received via the network, stored to an internal hard disk 85 or other storage media, and then supplied therefrom to the printer 10. It will also be obvious that the printer 10 could comprise a LAN hardware and software enabling direct connection to the network such that a control program, print data, or other information can be supplied directly to the printer 10 via the network.

The configuration of control unit 50 comprising a function for controlling the operation for loading (setting) a printing form to the paper path 11 of a printer 10 according to the present embodiment is described in further detail below with reference to FIG. 2. As shown in FIG. 2, control unit 50 comprises a paper detection unit 55, a mechanical control unit 56, a status determination unit 58, a bypass unit 54, flash memory 59, and an interface 57.

The paper detection unit 55 determines whether a form is present using BOF sensor 21 and TOF sensor 22. The mechanical control unit 56 controls, for example, platen 36, paper transport mechanism 34, and print head 37. The status determination unit 58 evaluates the printing form loading status based on the detection result output from the paper detection unit 55 when the transport mechanism 34 is driven in the forward or reverse direction after it has been made operable in response to detection of slip form 1 by the paper detection unit 55.

The status determination unit 58 comprises first and second evaluation units 51 and 52, and an indexing unit 53. The first evaluation unit 51 drives the transport mechanism 34 in a forward direction, detects printing form presence using BOF sensor 21, and checks for form skewing. The second evaluation unit 52 drives the transport mechanism 34 in the opposite direction, detects printing form presence using TOF sensor 22, and detects the leading edge of the slip form 1. The indexing unit 53 drives the transport mechanism 34 a specific distance in the forward direction and detects printing form presence using the TOF sensor 22 to index the form to a specific position. This status determination unit 58 can therefore be used for an auto-loading operation whereby the form 1 is consistently and automatically loaded to the same position.

The bypass unit 54 enables printing to be started without evaluating the form loading status by bypassing the status determination unit 58. The bypass unit 54 therefore enables a form 1 to be inserted with the desired printing position 1*a* thereon aligned with the print head (referred to as "positioned insertion" below) for targeted printing directly to a desired position 1*a* on the printing form 1.

The functional units described above are achieved in a control program stored in flash memory 59, and the instructions of the control program for implementing various processes under appropriate conditions and timings are loaded into a CPU or other processor used as the control unit 50. The control program and other data can be supplied to the flash memory 59 from the interface 57, thereby enabling the control programs stored in flash memory 59 to be updated and maintained. In addition to being automatically controlled by a control program, the mechanical control unit 56 can also be manually controlled using control panel 8*a*.

The determination of whether the bypass unit 54 bypasses the status determination unit 58 is controlled by a form insertion selection command from the host 81 for selecting the operation to be executed when a form is inserted. This form insertion selection command has the form "ESC x n" where n is an integer from 1 to 2. In hexadecimal form, this command has the exemplary form "1Bh 78h n," which, it will be obvious, can be appropriately changed. More specifically, the command ESC x is a predefined command for selecting the process to be implemented when a cut-sheet form is inserted, and parameter n is the argument specifying which process to implement.

In an exemplary embodiment of the invention, a value n=1 does not bypass the status determination unit 58 and enables the auto-loading operation. A value n=2 bypasses the status determination unit 58 and enables the above-noted positioned insertion operation.

Figure 3:
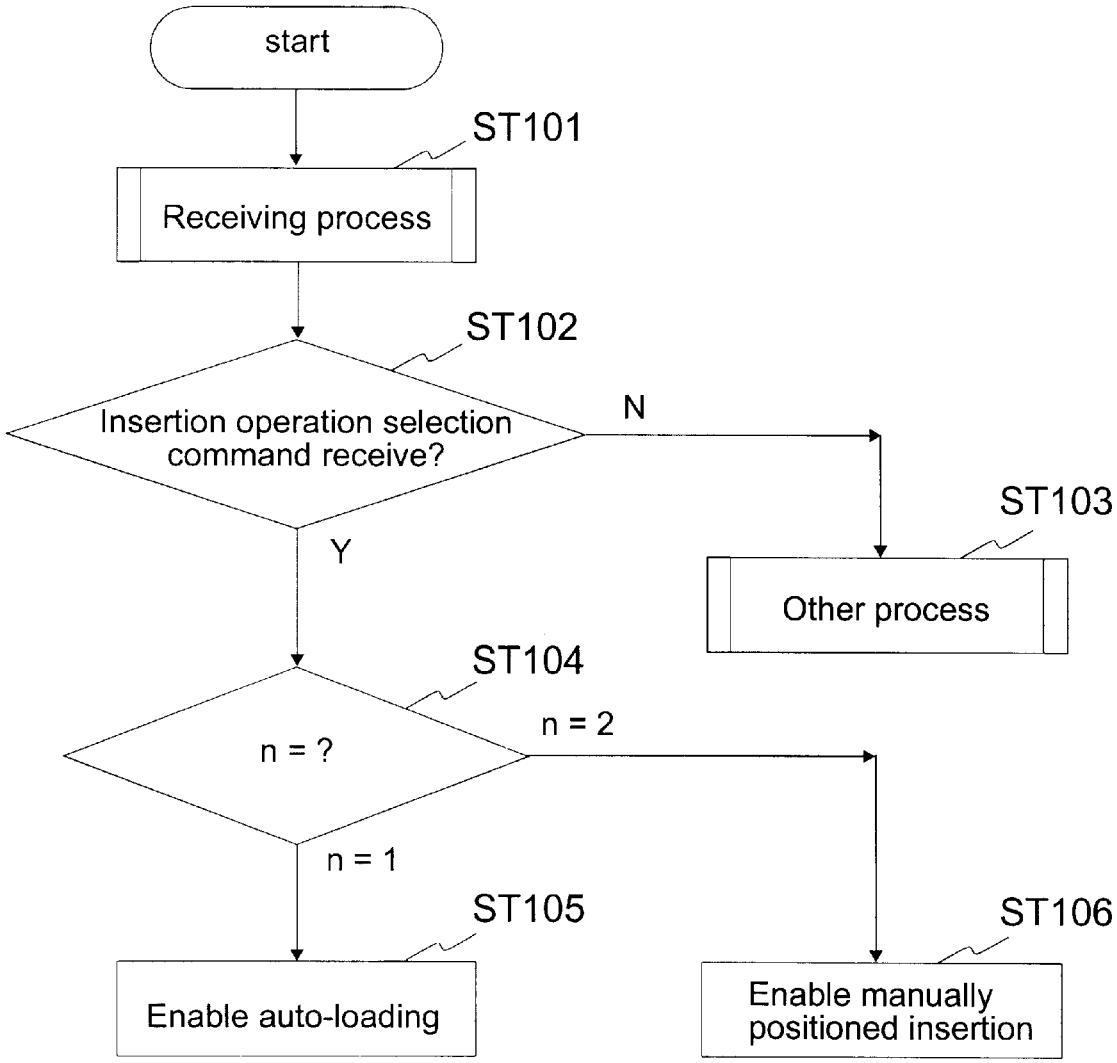
FIG. 3 is a flow chart used to describe the process for selecting the operation performed when a cut-sheet form is inserted to the printer shown in FIG. 1.

Use of this form insertion selection command is described in further detail below with reference to the flow chart in FIG. 3. The procedure starts when command data or print data sent from a host is received (step ST 101). It is then determined whether the received data is a form insertion selection command (ST 102). If the received data is not a form insertion selection command, a process appropriate to the receive command data or other data is performed (ST 103). If the received data is a form insertion selection command, the value of parameter n is determined (ST 104). If n=1, auto-loading is enabled (ST 105); if n=2, positioned insertion is enabled (ST 106).

Note that by storing the insertion mode information (the parameter n) detected by this process to RAM or other storage device, it can be referenced in subsequent processes to determine what process to execute at form insertion.

The operation of the component units of control unit 50 is described in further detail below with reference to the flow charts shown in FIG. 4 to FIG. 7.

Figure 4:
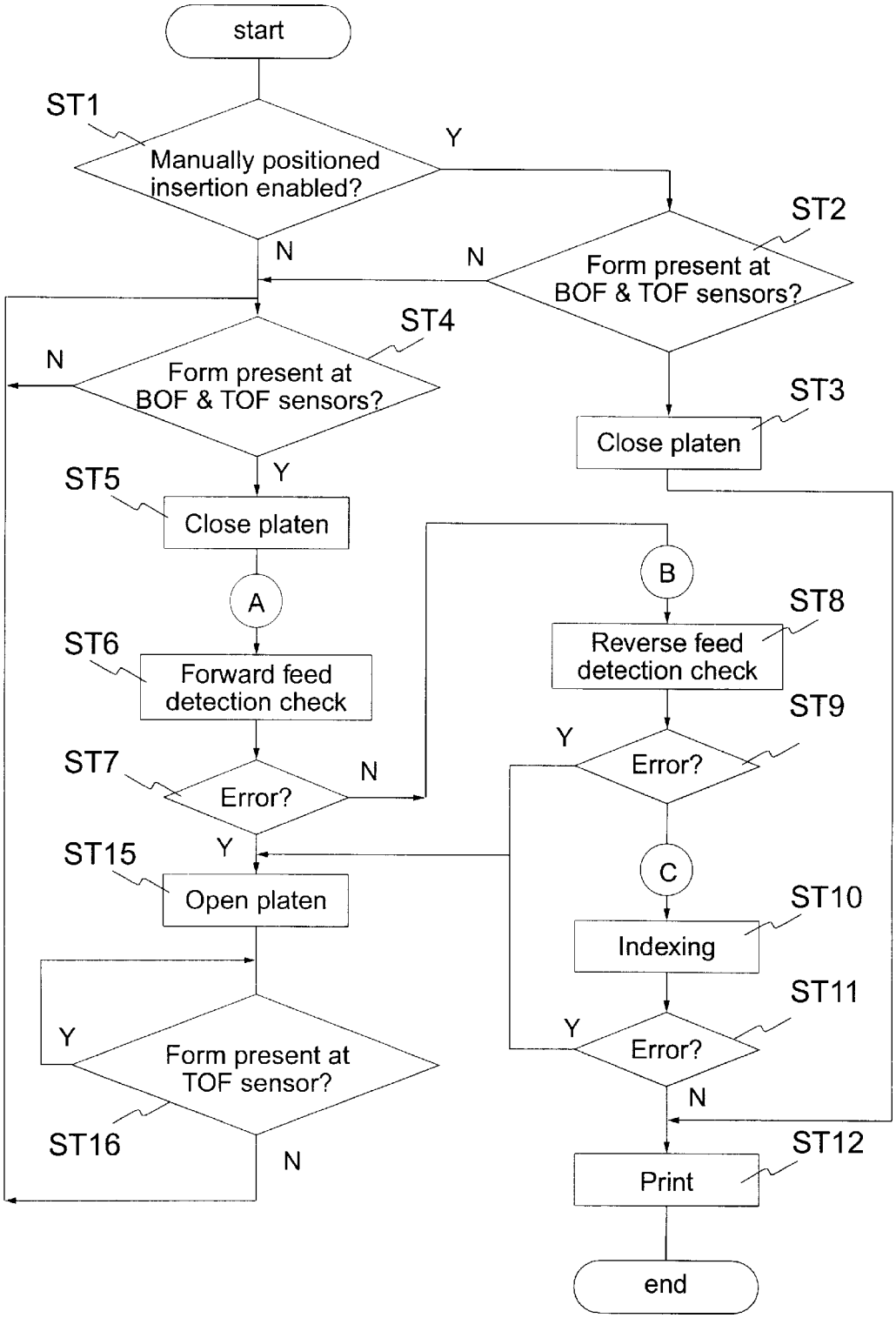
FIG. 4 is a flow chart used to describe the operation controlling loading a form to the printer shown in FIG. 1.

FIG. 4 shows a series of steps for setting printing form 1 in printer 10 of the present embodiment. When a printing instruction or printing data is supplied from the host 81 in step ST1, bypass unit 54 determines whether targeted printing (positioned insertion) is enabled. If targeted printing is enabled, the presence of paper is detected using TOF sensor 22 and BOF sensor 21 in step ST2. If printing form 1 has been set in insertion area 12 of paper path 11 and if both TOF sensor 22 and BOF sensor 21 indicate the presence of paper, platen 36 is closed in step ST3 and paper transport mechanism 34 is made operable. The process then shifts to step ST12 and printing begins.

On the other hand, if targeted printing is not enabled in step ST1, the process shifts to step ST4 and printer 10 waits for printing form 1 to be set in insertion area 12 of paper path 11. Also, if printing form 1 is not set in insertion area 12 in step ST2 even though an instruction for targeted printing was received, targeted printing is canceled, the process shifts to step ST4, and printer 10 waits for printing form 1 to be set in insertion area 12.

Targeted printing is disabled under these conditions to prevent form buckling or bending, interference with traverse movement of the print head 37 and the resulting misalignment or desynchronization of the carriage, or paper jams as a result of the user inserting a form from the X direction (FIG. 1) rather than the Y direction and continuing to push the form. The procedure therefore shifts to step ST4 to prevent this by temporarily enabling the auto-loading operation. Note that an inserted form will not become buckled or bent in a printer in which there is no form stop. In this case, therefore, it is possible to wait in step ST2 until a form is inserted without shifting to step ST4.

When printing form 1 is set in insertion area 12 and both TOF sensor 22 and BOF sensor 21 indicate the presence of paper in step ST4, platen 36 is closed in step ST5 and paper transport mechanism 34 is made operable in conjunction therewith.

As described above, printer 10 of the present embodiment checks the loading status of printing form 1 before beginning printing when printing form 1 is set in insertion area 12 of paper path 11 and paper transport mechanism 34 becomes operable. For this reason, the loading status of the printing form is checked in steps ST6, ST8, and ST10. To accomplish this, first evaluation unit 51 performs a first evaluation process whereby transport mechanism 34 is driven in the forward direction (printing form 1 insertion direction) to check for skew step ST6.

Figure 5:
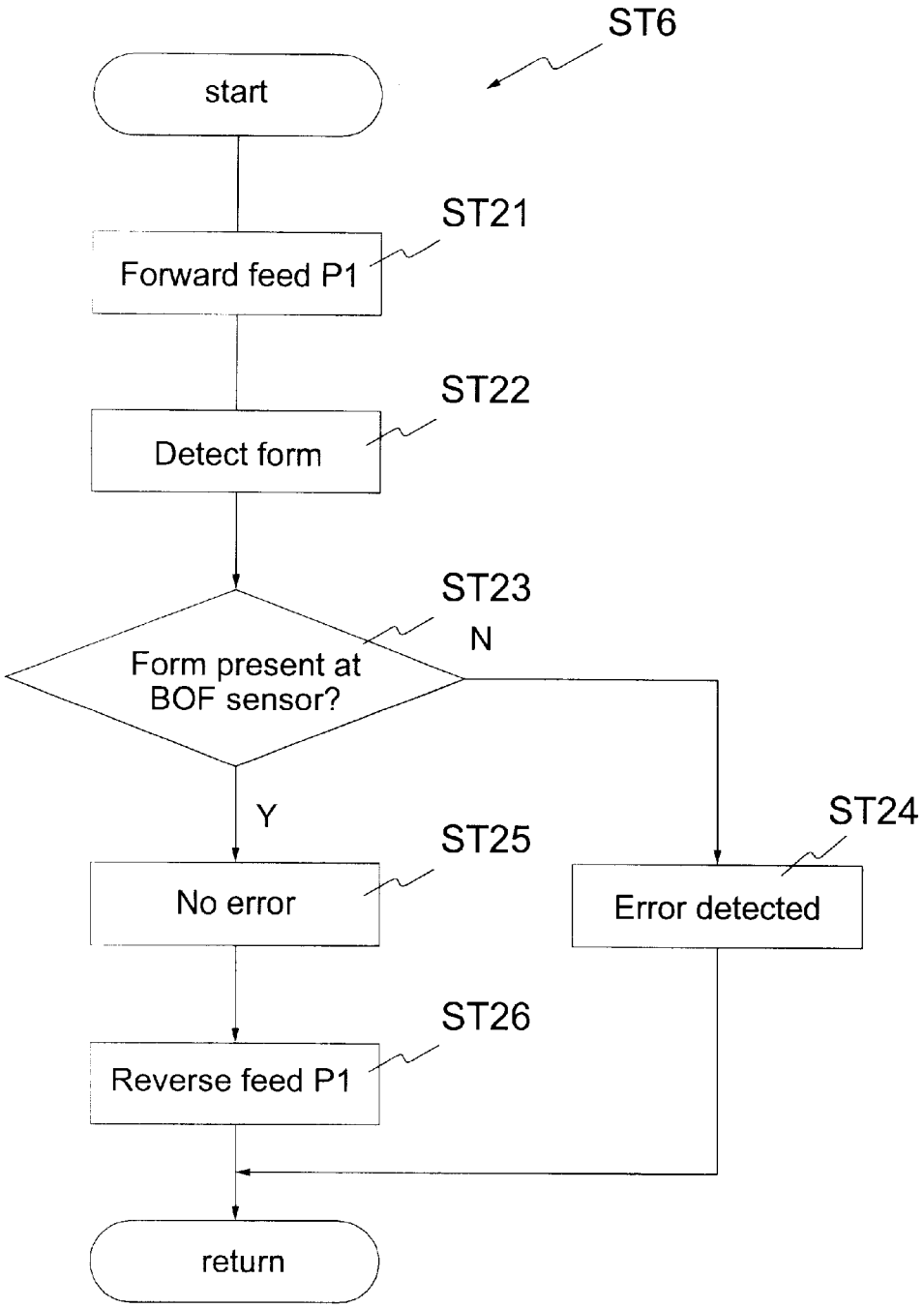
FIG. 5 is a flow chart used to describe the operation controlling a first evaluation process for checking skewing of a form in the printer shown in FIG. 1.
Figure 8:
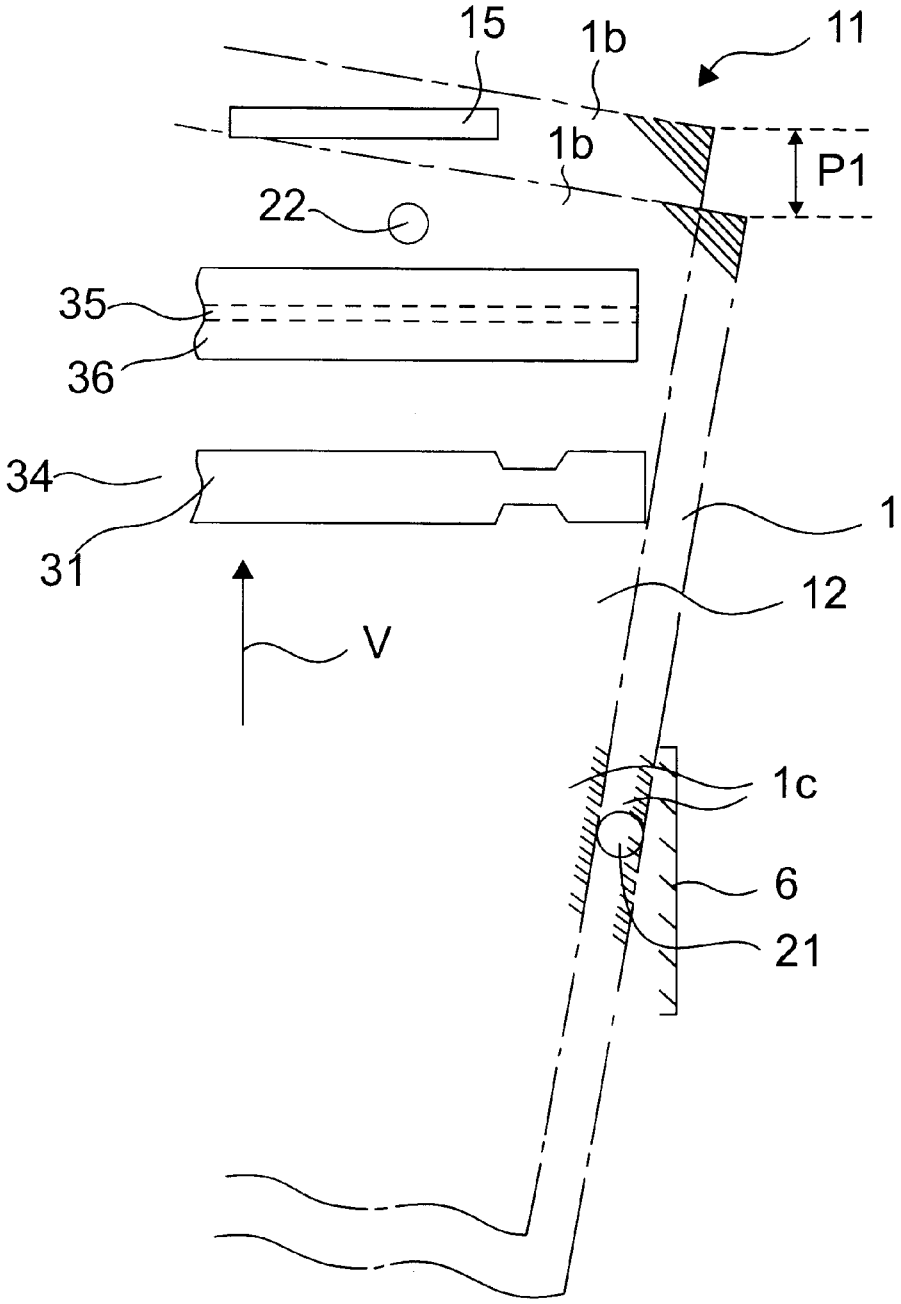
FIG. 8 is a typical plan view illustrating movement of a printing form during the skew detection process shown in FIG. 5.

This first evaluation process (step ST6) is described in detail below with reference to the flow chart in FIG. 5. A typical plan view of printing form 1 when skewed in paper path 11 is shown in FIG. 8. At step ST21 in FIG. 5, transport mechanism 34 is driven an appropriate distance P1 in forward direction V as shown in FIG. 8, and a first form detection operation is then performed in step ST22 after waiting for the output of BOF sensor to stabilize. If, as a result of this detection, BOF sensor 21 determines in step ST23 that a form is not present, printing form 1 is skewed to paper path 11 as shown in FIG. 8. An error flag is therefore set in step ST24. However, if BOF sensor 21 determines that paper is present in step ST23, printing form 1 is not skewed to paper path 11, the error flag is cleared (step ST25), and the transport mechanism 34 is driven in the direction opposite from that in step ST21 by distance P1 (step ST26), returning printing form 1 to its original position.

As shown in FIG. 8, BOF sensor 21 is a paper sensor provided in paper path 11 for detecting the presence of slip forms 1 and the end of the paper being printed, and is positioned near fixed paper guide 6 outside (before) insertion area 12. As a result, BOF sensor 21 senses right edge 1*c* of printing form 1, which contacts paper guide 6. Consequently, if printing form 1 has not been inserted along paper guide 6 and only partially contacts paper guide 6, BOF sensor 21 will not detect printing form 1 as it moves along paper path 11, and skew can be detected.

In printer 10 of the present embodiment, paper guide 6 is relatively long and BOF sensor 21 is installed relatively close to the inside end (the insertion direction side) of paper guide 6, which guides right edge 1*c* of printing form 1.

Consequently, if the paper is skewed to the left relative to the forward direction (insertion direction) V, there is little possibility that BOF sensor 21 will sense the paper in step ST4, and thus platen 36 will not close. However, printing form 1 can also become skewed to the right relative to the direction V. The slip form 1 is therefore advanced in step ST21 to detect skewing on the right side as seen in FIG. 8. While distance P1 in the forward direction can be set to an appropriate value based on the width of paper path 11 and the size of paper guide 6, a range from several millimeters to several centimeters is sufficient.

Figure 9:
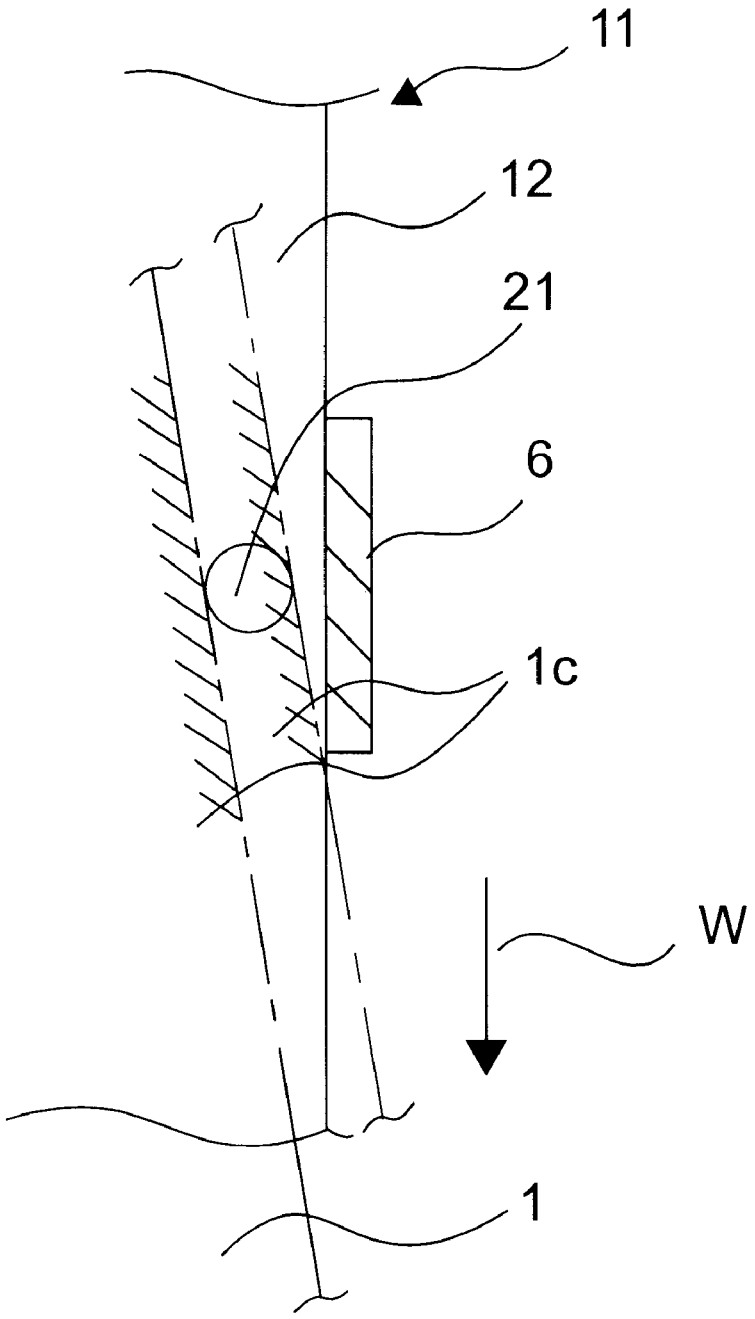
FIG. 9 is a typical plan view illustrating movement of a printing form during the detection of skew in a different direction from that shown in FIG. 8.

If paper guide 6 is relatively small or if BOF sensor 21 is installed in a position near the front (reverse travel direction) of paper guide 6, there is a tendency that BOF sensor 21 indicates form presence while the form is skewed to the left as shown in FIG. 9. In this case, skew can be detected by driving the transport mechanism 34, to effect an appropriate transport distance in the reverse direction W in FIG. 9, and similarly detecting form presence after the form is reversed by a particular distance.

Instead of using the BOF sensor 21 for skew detection by detecting the trailing edge of the slip form 1, it is also possible to detect skew using the TOF sensor 22 to detect the leading edge, that is, the insertion end, of the slip form 1 placed to the entrance to the insertion area 12. Skew detection, however, requires detecting edge 1*c* of printing form 1, and there is a greater tendency for tears or wrinkles to appear on the long side at the leading edge of a printing form 1. The detection rate therefore drops if TOF sensor 22, placed near this edge 1*c* is used for detecting the skew.

In a printer 10 according to the present embodiment, the TOF sensor 22 is therefore placed in the middle of the paper path 11 to improve the printing form 1 detection rate, and the BOF sensor 21 is placed proximal to the fixed paper guide 6 to reliably detect the edge 1*c* of printing form 1 and dependably detect skewing.

Referring again to FIG. 4, if skewing is detected and the error flag is set in step ST6, an error routine is implemented in step ST7, platen 36 is opened in step ST15, and the transport mechanism 34 is concomitantly released, thus freeing printing form 1. A message prompting the user to reset the printing paper is also displayed on the host 81 or printer 10. The printer 10 then waits for printing form 1 to be removed from insertion area 12 as determined in step ST16 by TOF sensor 22 no longer detecting printing form 1. When the printing form 1 is removed, the procedure returns to step ST4 and the printer waits for printing form 1 to be reset. If it is confirmed in step ST6 that the form is not skewed, the error routine is implemented in step ST7, and the process shifts to step ST8 wherein the second evaluation unit 52 executes a second evaluation process whereby the printing form 1 is reversed to detect the leading edge 1*b* of the printing form 1 in the paper path 11.

Figure 6:
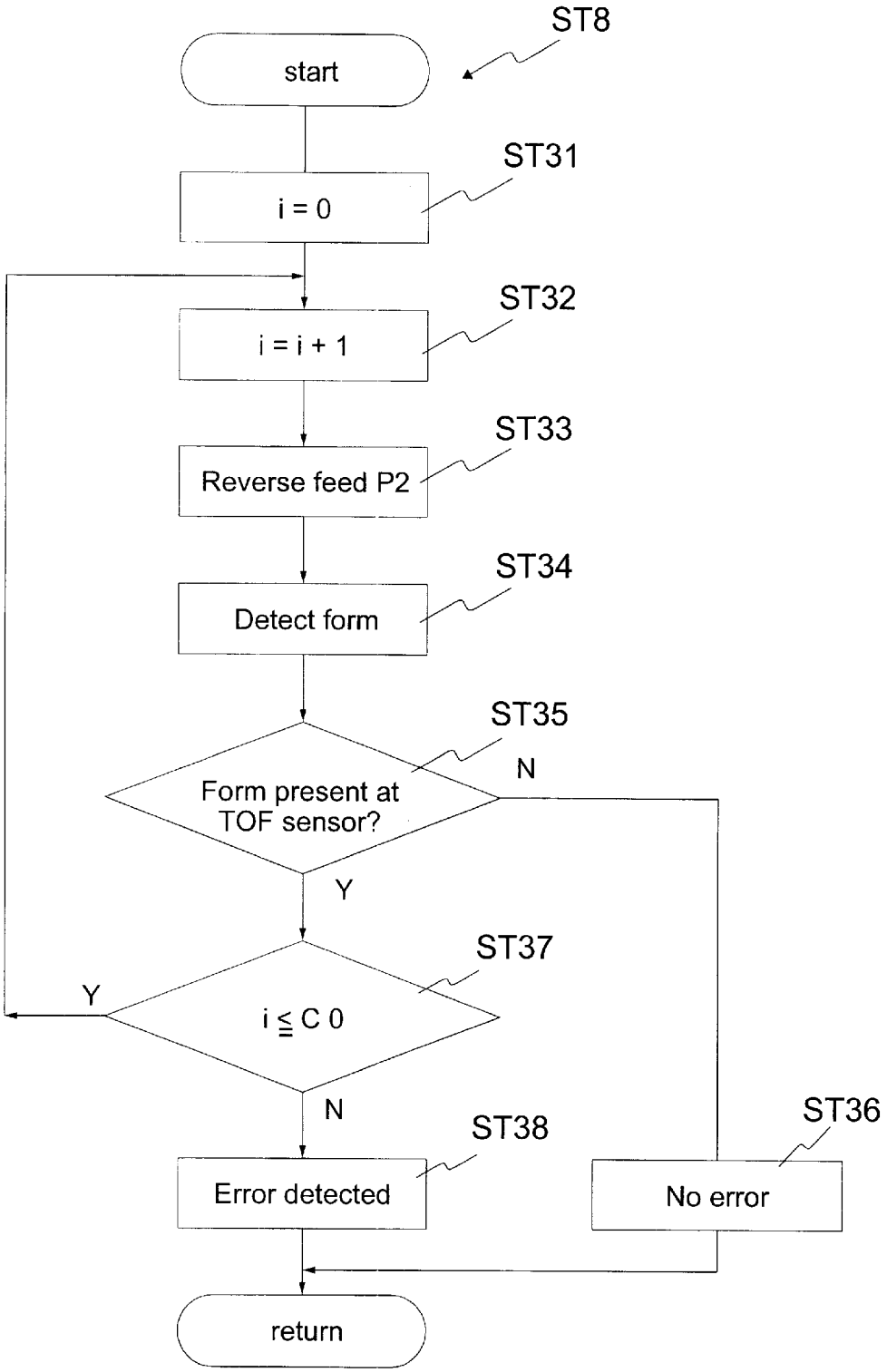
FIG. 6 is a flow chart used to describe the operation controlling a second evaluation process for detecting the leading edge of a form in the printer shown in FIG. 1.
Figure 7:
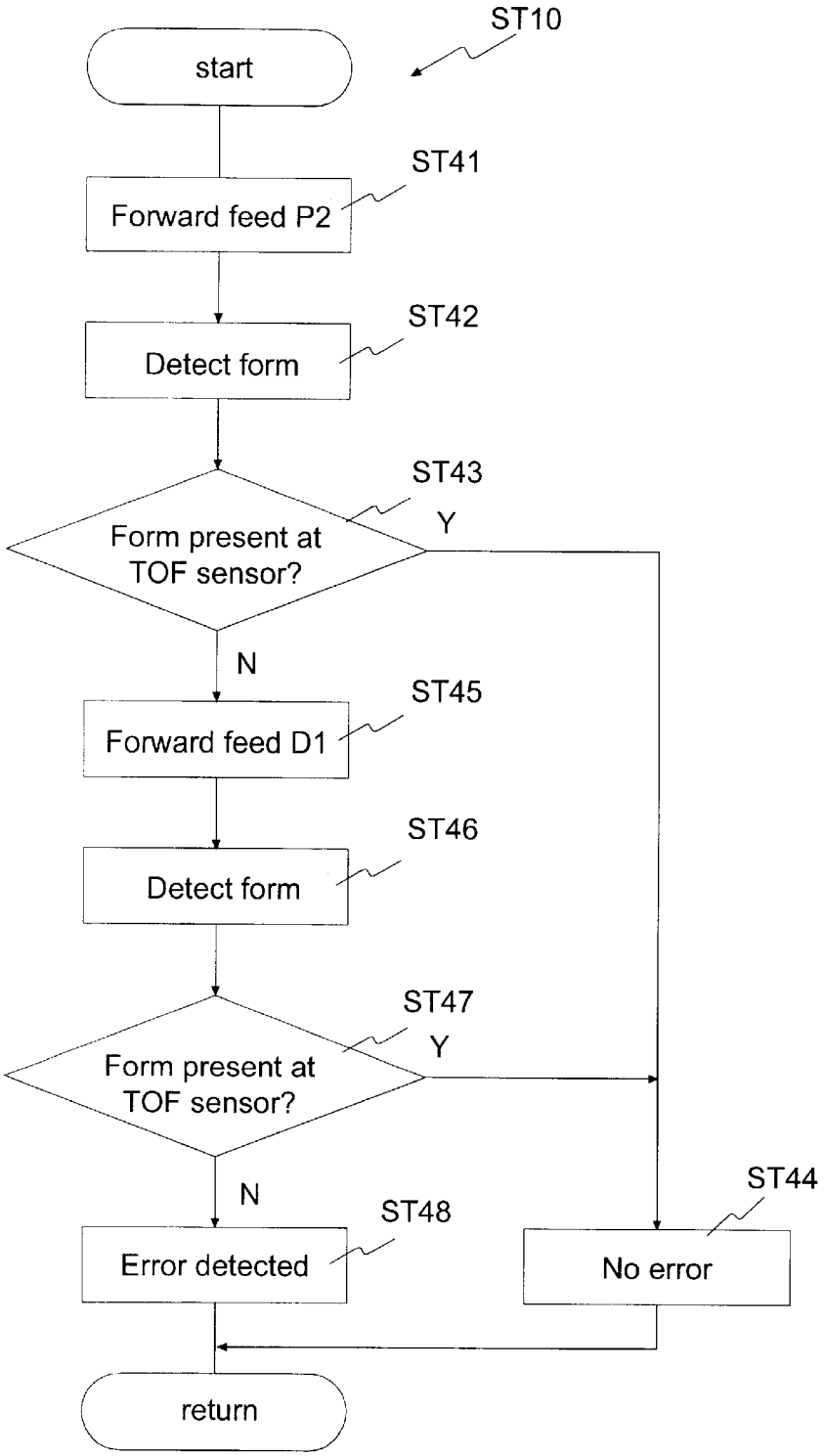
FIG. 7 is a flow chart used to describe the operation controlling a leading edge indexing operation in the printer shown in FIG. 1.
Figure 10:
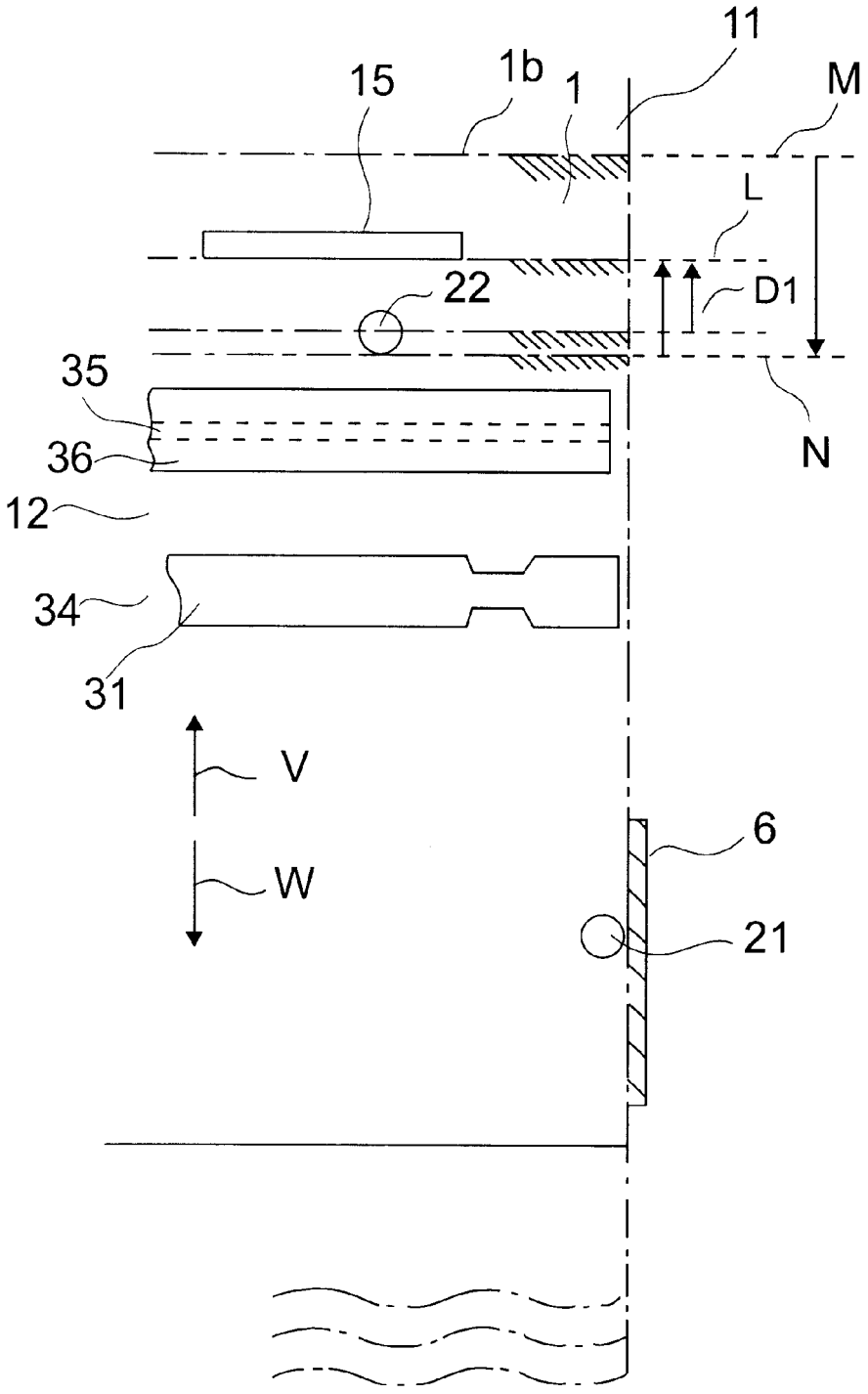
FIG. 10 is a typical plan view illustrating movement of a printing form during a leading edge detection and indexing operation.

This second evaluation process (step ST8 in FIG. 4) is described in detail below with reference to the flow chart in FIG. 6. A typical plan view of the printing form 1 in the paper path 11 when the leading edge 1*b* of the form is detected at position N, as shown in FIG. 10. At step ST31, a variable i, which is used in the subsequent steps for counting the number of times reverse transportation occurs, is initialized to 0, and is then immediately incremented 1 in step ST32. The transport mechanism 34 is then driven in reverse direction distance P2 (step ST33), and a second form detection operation is performed in step ST34 after waiting for the output of TOF sensor 22 to stabilize. If as a result of this detection TOF sensor 22 determines in step ST35 that a form is not present, the leading edge 1*b* of printing form 1 has passed the position of TOF sensor 22, and the position of leading edge 1*b* of paper 1 has been confirmed. An error flag is therefore cleared in step ST36, and the procedure ends.

On the other hand, if the presence of paper is indicated in step ST35, the position of leading edge 1*b* cannot be confirmed. If counter i is equal to or less than a predetermined count C0 in step ST37, the process returns to step ST32 and the reverse feeding and leading edge detection loop repeats. If counter i exceeds the predetermined count C0 in step ST37, the position of leading edge 1*b* of paper 1 cannot be confirmed even though transport mechanism 34 has been driven the specified distance. An error flag is therefore set in step ST38, and the procedure ends.

As shown in FIG. 10, form stop 15 interrupts the paper path 11 when a printing form 1 is inserted to the insertion area 12 of the paper path 11, and the leading edge 1*b* of printing form 1 therefore stops against the form stop 15. The leading edge 1*b* of printing form 1 should therefore become aligned with position L of the form stop 15. However, contact between the leading edge 1*b* of printing form 1 and the form stop 15 can be hard for the user to detect depending on the type of medium used for the printing form 1. When this happens, there is a tendency to continue inserting the printing form 1 even though it is fully inserted to the form stop 15, resulting in the platen 36 closing with the form buckled or bent inside the paper path 11. When the form stop 15 is then retracted in order to start printing, the leading edge 1*b* of printing form 1 typically extends forward into the paper path 11 to a position M inside from the form stop 15. Irrespective of the tactile response of contact with the form stop 15, inserting the printing form 1 with excessive force can also result in the platen 36 closing with the form buckled or bent inside the paper path 11, again advancing forward of the form stop 15. The form can also bounce off the form stop 15, resulting in the platen 36 closing and printing starting without the leading edge 1*b* of printing form 1 positioned at the form stop 15.

The reference position for printing on form 1 is the position in which platen 36 is closed and transport mechanism 34 is made to hold form 1. Therefore, in order to accurately print to the desired location on printing form 1, the leading edge 1*b* of each form must be set to the same position. The printer 10 according to the present embodiment therefore confirms the position of the leading edge 1*b* by reversing the printing form 1 inserted to the paper path 11. The distance (pitch) P2 used for this reverse feed process is preferably approximately on the order of several millimeters with the precise distance determined by such considerations as the printing precision and the detection precision of the TOF sensor 22. The leading edge 1*b* of printing form 1 can thus be precisely and reliably positioned by detecting the leading edge 1*b* concurrently to feeding the form in a reverse direction at a known pitch. Therefore, even if the user does not insert the leading edge 1*b* of printing form 1 to the same position, the leading edge 1*b* can be automatically aligned to a particular position N on the entrance side of the TOF sensor 22 by reversing the printing form 1 in direction W in FIG. 10 until the leading edge 1*b* passes the TOF sensor 22.

Paper jams and other problems can also result when the printing form 1 is inserted wrinkled or bent inside the paper path 11, and printing will not occur normally if started with the printing form 1 thus loaded. In a printer 10 according to the present embodiment, an error is generated in step ST38 of FIG. 6 when the leading edge 1*b* is not detected even though the form is reversed a specific distance by the transport mechanism 34 in step ST37.

Returning to FIG. 4, when an error is detected at step ST9 in FIG. 4, the error routine starting from step ST11 is executed. This error routine causes the user to be prompted to reset the printing form 1 when the form cannot be correctly positioned because of a possible paper jam or other cause, and prevents printing from starting.

It is therefore possible using a printer 10 according to the present invention to reliably print personal checks and other forms without wasting forms due to loading errors, and such cut-sheet forms can be reliably loaded to a specific position. When the leading edge 1*b* of printing form 1 is detected by the TOF sensor 22 at step ST8, the indexing unit 53 operates in step ST10. This causes the printing form 1 to be indexed to the desired position. This indexing operation (step ST10) is described in detail below with reference to the flow chart in FIG. 7. A typical plan view of the printing form 1 in the paper path 11 for the indexing operation described below is shown in FIG. 10.

It should be noted that the indexing position for the leading edge 1*b* of printing form 1 in step ST8 can be set in a printer 10 according to the present embodiment to position N in FIG. 10, that is, to a position on the outside side of the TOF sensor 22 relative to the paper path 11. However, this printer 10 uses position L at the form stop 15 as the reference position for printing. It is therefore necessary to advance the leading edge 1*b* from position N forward again to position L. At step ST10, therefore, the form is advanced a small distance (from position N to position L) in the forward direction for indexing. The form is therefore advanced in step ST41 the same pitch distance P2 used for reverse feeding in step ST8, and the leading edge is detected in step ST42 after waiting for the output of TOF sensor to stabilize. If as a result of this detection TOF sensor 22 detects the form in step ST43, indexing is completed, an error flag is therefore cleared in step ST44, and the procedure ends.

However, if the form is not detected in step ST43, the form is again advanced in step ST45 in the direction of arrow V, by an amount corresponding to the distance D1 between L and the center of TOF sensor 22. In this case it is assumed that the leading edge 1*b* of form 1 is just at a position difficult to detect by TOF sensor 22, namely at the center of the sensor. The form is then detected in step ST46 after waiting for the output of TOF sensor to stabilize. If the TOF sensor 22 detects the form in step ST47, indexing is completed, an error flag is therefore cleared in step ST44, and the procedure ends. If the TOF sensor 22 was unable to detect the form in step ST47, in an error flag is set in step ST48 to indicate that there is a problem, and the indexing operation stops.

As thus shown in FIG. 10, the indexing operation of step ST10 can align the leading edge 1*b* of printing form 1 to position L at the form stop 15 with tolerance of within P2 by advancing the leading edge 1*b* of printing form 1 in forward direction V from position N. The printing form 1 can therefore be transported reliably referenced to this same position for printing in the printing area 35 of the platen 36 (the printing position of the print head 37) with excellent precision and good reproducibility.

As described above, a printer 10 according to the present invention can selectively perform an auto-loading operation and a positioned insertion operation based on a supplied command selecting the form insertion operation to perform. When the positioned insertion operation is selected and auto-loading is disabled, the user can easily insert a form for printing to a desired location. A printer 10 according to the present invention can therefore easily accommodate printing from the leading edge (top edge) of a cut-sheet form as commonly performed with POS printers, as well as printing to a specific position on a cut-sheet form as required for printing an amount on a check. A printing form can thus be loaded either automatically or manually for reliably printing to a specific position conforming to a particular format.

It will be obvious from the foregoing description that while the present invention has been described with reference to a printer comprising a form stop, it can also be applied to a printer not having a form stop. In this type of printer, the platen and transportation rollers can be closed and printing started when the BOF sensor and TOF sensor detect that a form has been inserted when positioned insertion (targeted printing) is selected. When auto-loading is selected, skew and the leading edge of the form are detected as described above, and printing can again commence reliably referenced to a common printing position.

It will also be obvious from the foregoing description that the control method for the above described printing apparatus according to the present invention can be provided as a control program for executing the processes shown in the accompanying flow charts and stored to any recording medium that can be read or accessed by a CPU or other processor. Such a control program can obviously be provided using a wide range of media, including computer RAM or ROM as well as floppy disks and other non-fixed, exchangeable media. In addition, the control program can be provided via a computer network or communications network, including the Internet, and can be recorded to a hard disk or other fixed recording medium.

As will be known from the preceding description, a printing apparatus according to the present invention can selectively implement the operation performed when a cut-sheet form is inserted thereto, and can therefore be used with either auto-loading or manually positioned insertion loading according to the specific printing objective. If manually positioned insertion loading is selected, targeted printing to a manually adjusted printing position is possible with the printing form used as positioned by the user. A printer that can be used for printing to media of different formats can therefore be provided.

While the invention has been described in conjunction with several specific embodiments, it will be evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A control method for controlling a printing apparatus comprising an interface for communicating with a host device, a detector for detecting the presence of a cut-sheet form, a transport mechanism for transporting a cut-sheet form, and a printing unit for printing to a cut-sheet form, said control method comprising the steps of:

receiving one of print data and the print command from a host device;

detecting the presence of a cut-sheet form;

positioning the leading edge of an inserted cut-sheet form to a specific position by transporting and detecting the cut-sheet form;

printing to the cut-sheet form according to one of received print data and the received print command; and skipping the printing form positioning step according to a specific command from the host device.

2. The printing apparatus control method according to claim 1, further comprising the step of:

storing a setting controlling whether the printing form positioning step is to be skipped.

3. The printing apparatus control method according to claim 1, wherein when the positioning step is set to be skipped and the form detecting step detects that a cut-sheet form is not present, the positioning step is executed.

4. A medium readable by a machine embodying a program of instructions executable by said machine to perform a method for controlling a printing apparatus, the method comprising the steps of:

receiving one of print data and a print command from a host device;

detecting the presence of a cut-sheet form;

positioning the leading edge of an inserted cut-sheet form to a specific position by transporting and detecting the cut-sheet form;

printing to the cut-sheet form according to one of received print data and the received print command; and skipping the printing form positioning step according to a specific command from the host device.

5. The medium according to claim 4, wherein the method for controlling the printing apparatus further comprises:

storing a setting controlling whether the printing form positioning step is to be skipped.

6. The medium according to claim 4, wherein when the positioning step is set to be skipped and the form detecting step detects that a cut-sheet form is not present, the positioning step is executed.

* * * * *